US009835185B2

(12) United States Patent
Hagino et al.

(10) Patent No.: US 9,835,185 B2
(45) Date of Patent: Dec. 5, 2017

(54) INDUSTRIAL VEHICLE

(71) Applicants: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

(72) Inventors: Kenichi Hagino, Kariya (JP); Tetsuya Goto, Kariya (JP); Shigeto Nakajima, Nagano (JP); Takahiro Koyama, Nagano (JP); Satoshi Takano, Nagano (JP)

(73) Assignees: KABUSHIKI KAISHA TOYOTA JIDOSHOKKI, Kariya-shi (JP); NISHINA INDUSTRIAL CO., LTD., Nagano-shi (JP)

( * ) Notice: Subject to any disclaimer, the term of this patent is extended or adjusted under 35 U.S.C. 154(b) by 346 days.

(21) Appl. No.: 14/666,541

(22) Filed: Mar. 24, 2015

(65) Prior Publication Data

US 2015/0275936 A1 Oct. 1, 2015

(30) Foreign Application Priority Data

Mar. 26, 2014 (JP) ..... 2014-064797

(51) Int. Cl.
*F15B 15/20* (2006.01)
*F15B 15/24* (2006.01)
*B66F 9/22* (2006.01)

(52) U.S. Cl.
CPC ..... *F15B 15/24* (2013.01); *B66F 9/22* (2013.01); *F15B 15/202* (2013.01); *F15B 2215/30* (2013.01)

(58) Field of Classification Search
CPC ..... F15B 15/24; F15B 15/202; F15B 9/08; F15B 11/163; F15B 13/026;
(Continued)

(56) References Cited

U.S. PATENT DOCUMENTS 9,181,070 B2 * 11/2015 Sugano ..... B66D 1/44
2006/0060409 A1 3/2006 Dammeyer et al.
2007/0210645 A1 9/2007 Dornbach

FOREIGN PATENT DOCUMENTS

JP 2012-62137 A 3/2012
JP 5113129 B2 1/2013

OTHER PUBLICATIONS

Communication dated Jul. 30, 2015 from the European Patent Office in counterpart European Application No. 15160241.4.

* cited by examiner

*Primary Examiner* — Logan Kraft
*Assistant Examiner* — Abiy Teka
(74) *Attorney, Agent, or Firm* — Sughrue Mion, PLLC

(57) ABSTRACT

A hydraulic mechanism is mounted on a forklift. The hydraulic mechanism has a control valve and a pressure compensation circuit for compensating pressure within the hydraulic mechanism. The pressure compensation circuit has a relief pressure valve and an unloading valve for releasing pressure within the pressure compensation circuit to a discharge oil passage. Upon instructed to perform cargo handling operation, the unloading valve is switched to an open state, and the relief pressure valve is thereby actuated, so that rapid increase of pressure within the circuit is avoided. Further, the unloading valve is switched to an open state, and the pressure within the hydraulic mechanism is thereby released to the discharge oil passage, so that the cargo handling operation by the tilt cylinder and the lift cylinder is restricted.

3 Claims, 4 Drawing Sheets

(58) Field of Classification Search
CPC .. F15B 2211/40553; F15B 2211/40561; F15B 2211/40569; F15B 2211/50536; B66F 9/22
See application file for complete search history.

INDUSTRIAL VEHICLE

BACKGROUND OF THE INVENTION

The present invention relates to an industrial vehicle equipped with a hydraulic actuating device.

As this type of industrial vehicles, a forklift is known. The forklift includes an engine, a hydraulic pump driven by the engine, and a hydraulic actuating device actuated by hydraulic oil discharged from the hydraulic pump. The forklift has a hydraulic cylinder for moving a fork upward or downward and a hydraulic cylinder for tilting a mast. When the hydraulic pump is driven by the engine, engine torque may become insufficient as the load of the hydraulic pump increases, which may cause an engine stall. To address this, Japanese Laid-Open Patent Publication No. 2012-62137 proposes a configuration for preventing occurrence of an engine stall.

However, with the configuration of Japanese Laid-Open Patent Publication No. 2012-62137, while it is possible to prevent occurrence of an engine stall, it is necessary to add a structure for unloading a hydraulic circuit to restrict operation of a hydraulic actuating device.

SUMMARY OF THE INVENTION

An object of the present invention is to provide an industrial vehicle capable of performing unloading when necessary while preventing occurrence of an engine stall.

To solve the above-described problem, according to the first aspect of the present invention, an industrial vehicle is provided which includes an engine, a hydraulic pump driven by the engine, a hydraulic actuating device actuated by hydraulic pressure, a connection oil passage connecting the hydraulic pump and the hydraulic actuating device, a supply oil passage through which hydraulic oil to be supplied to the hydraulic actuating device passes, a discharge oil passage through which hydraulic oil to be discharged to an oil tank passes, an unloading valve connecting the supply oil passage and the discharge oil passage, a relief pressure valve connected to the supply oil passage and actuated by pressure of the hydraulic oil passing through the supply oil passage, a timer circuit unit connected to the supply oil passage and opening the supply oil passage when a certain time period has elapsed, and a control unit controlling a state of the unloading valve between an open state and a closed state. The control unit switches the state of the unloading valve to an open state when load is applied to the engine in a state where operation of the hydraulic actuating device is allowed, and switches the state of the unloading valve to an open state while the operation of the hydraulic actuating device is restricted.

DETAILED DESCRIPTION OF THE PREFERRED EMBODIMENTS

One embodiment in which an industrial vehicle of the present invention is embodied as a forklift will be described below according to FIG. 1 to FIG. 6.

Figure 1:
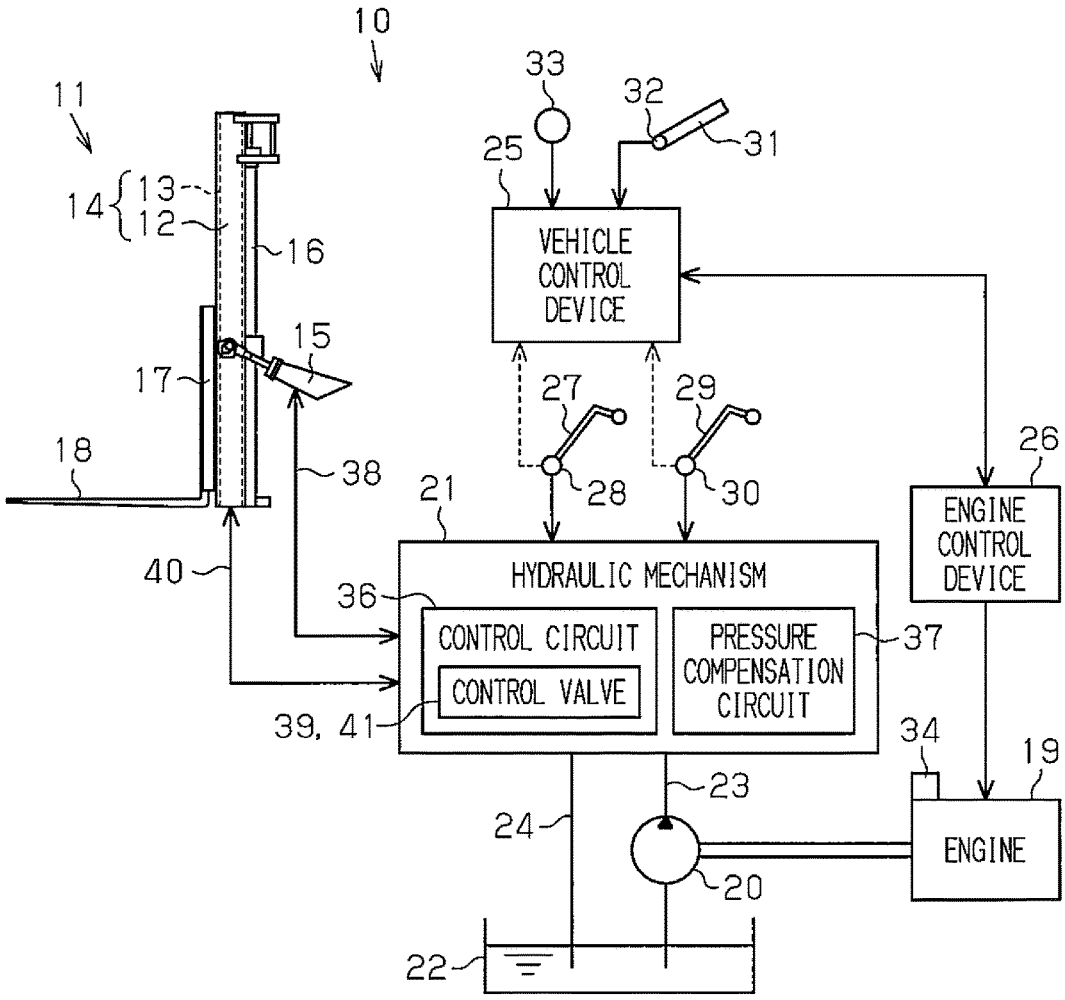
FIG. 1 is a schematic diagram illustrating an overall configuration of a forklift.

As illustrated in FIG. 1, a forklift 10 includes a vehicle body and a cargo handling device 11 mounted on the vehicle body. The cargo handling device 11 includes a multistage mast 14. The multistage mast 14 is constructed of a pair of right and left masts: an outer mast 12 and an inner mast 13. A hydraulic tilt cylinder 15 is coupled to the outer mast 12 as a hydraulic actuating device. A hydraulic lift cylinder 16 is coupled to the inner mast 13 as a hydraulic actuating device. When hydraulic oil is supplied to a tilt cylinder 15 or hydraulic oil is discharged from the tilt cylinder 15, the mast 14 tilts in a longitudinal direction of the vehicle body. When hydraulic oil is supplied to the lift cylinder 16 or hydraulic oil is discharged from the lift cylinder 16, the inner mast 13 moves in a vertical direction of the vehicle body. A fork 18 as a cargo handling tool is attached to the inner mast 13 via a lift bracket 17. When the lift cylinder 16 is actuated and the inner mast 13 moves upward or downward along the outer mast 12, the fork 18 moves upward or downward along with the lift bracket 17.

On the vehicle body of the forklift 10, an engine 19, a hydraulic pump 20 which is driven by the engine 19 and a hydraulic mechanism 21 are mounted. The engine 19 is a drive source for travelling operation and cargo handling operation of the forklift 10. Hydraulic oil ejected from the hydraulic pump 20 is supplied to the hydraulic mechanism 21. The hydraulic mechanism 21 controls supply and discharge of hydraulic oil to and from the cylinders 15 and 16. An oil passage 23 is connected to the hydraulic pump 20 to supply the hydraulic oil pumped from the oil tank 22 to the hydraulic mechanism 21. The oil passage 23 is connected to a discharge port of the hydraulic pump 20. To the hydraulic mechanism 21, a discharge oil passage 24 through which the hydraulic oil to be discharged to the oil tank 22 passes is connected.

On the vehicle body of the forklift 10, a vehicle control device 25 as a control unit and an engine control device 26 are mounted. The engine control device 26 is electrically connected to the vehicle control device 25. To the vehicle control device 25, a tilt sensor 28 detecting an operating state of a tilting operating member 27 and a lift sensor 30 detecting an operating state of a lifting operating member 29 are electrically connected. The tilting operating member 27 is a member for giving an instruction of operation of the tilt cylinder 15, while the lifting operating member 29 is a member for giving an instruction of operation of the lift cylinder 16. Further, an accelerator sensor 32 detecting an accelerator opening degree and an operator detecting sensor 33 detecting whether or not there is an operator are electrically connected to the vehicle control device 25. An accelerator operating member 31 is operated when the operator gives an instruction to accelerate the forklift 10. The tilting operating member 27, the lifting operating member 29 and the accelerator operating member 31 are disposed in an operating room of the forklift 10. The operator detecting sensor 33 is disposed at an operator's seat. The vehicle control device 25 detects whether or not an operator exists at a right operation position based on the detection result of the operator detecting sensor 33. When an operator does not exist at a right operation position, the vehicle control device 25 restricts cargo handling operation and travelling operation of the forklift 10.

Further, the vehicle control device 25 controls engine speed by outputting a speed instruction of the engine 19 to the engine control device 26. The engine control device 26 controls the engine 19 based on the speed instruction input to the engine control device 26. The engine control device 26 outputs the actual speed of the engine 19 detected by a speed sensor 34 to the vehicle control device 25. Because the hydraulic pump 20 is driven by the engine 19, the tilt cylinder 15 and the lift cylinder 16 are actuated when the operator steps on the accelerator operating member 31 and operates the tilting operating member 27 and the lifting operating member 29.

The hydraulic mechanism 21 has a control circuit 36 for controlling supply and discharge of hydraulic oil, and a pressure compensation circuit 37 for compensating pressure within the hydraulic mechanism 21. The control circuit 36 has control valves 39 and 41. The control valve 39 is connected to an oil chamber of the tilt cylinder 15 via an oil passage 38. The control valve 41 is connected to an oil chamber of the lift cylinder 16 via an oil passage 40. The control valves 39 and 41 are connected to the oil passage 23 and the discharge oil passage 24, respectively. The oil passages 23, 38 and 40 constitute a connection oil passage connecting the hydraulic pump 20, the tilt cylinder 15 and the lift cylinder 16.

The tilting operating member 27 is mechanically coupled to the control valve 39. Therefore, when the tilting operating member 27 is operated, a state of the control valve 39 is switched between an open state and a closed state. The lifting operating member 29 is mechanically coupled to the control valve 41. Therefore, when the lifting operating member 29 is operated, a state of the control valve 41 is switched between an open state and a closed state.

The hydraulic oil is discharged from the hydraulic pump 20 and flows into the control valves 39 and 41 through the oil passage 23. The hydraulic oil is supplied to the oil chambers of the cylinders 15 and 16 respectively through the oil passages 38 and 40. For example, when the tilting operating member 27 is operated, the hydraulic oil is discharged from the hydraulic pump 20 and supplied to the oil chamber of the tilt cylinder 15 through the oil passage 38 connected to the control valve 39. The hydraulic oil is discharged from the oil chambers of the cylinders 15 and 16 and discharged to the oil tank 22 through the discharge oil passage 24.

The pressure compensation circuit 37 will be described next with reference to FIG. 2 to FIG. 4.

Figure 2:
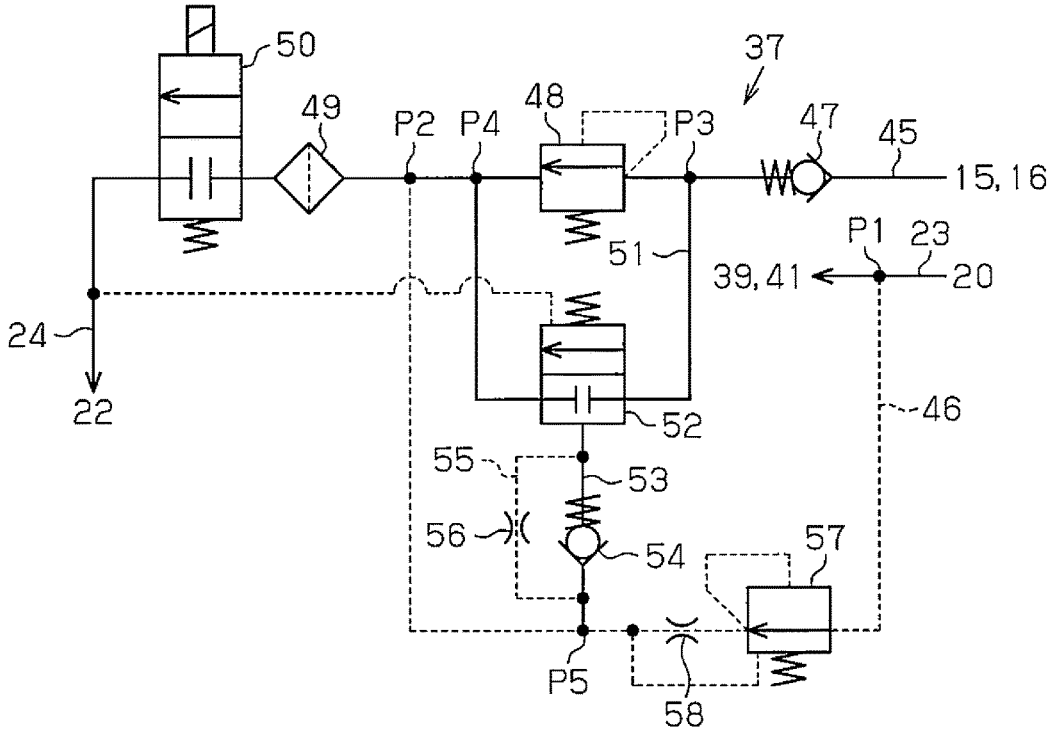
FIG. 2 is a hydraulic circuit diagram explaining a pressure compensation circuit having an unloading valve.

As illustrated in FIG. 2, the pressure compensation circuit 37 has a first supply oil passage 45 connected to the tilt cylinder 15 and the lift cylinder 16, and a second supply oil passage 46. The first supply oil passage 45 introduces sensing pressure of the cylinders 15 and 16 into the pressure compensation circuit 37. By this means, the first supply oil passage 45 becomes a supply oil passage through which hydraulic oil being supplied to the hydraulic actuating device passes. Further, the first supply oil passage 45 is connected to the discharge oil passage 24.

The second supply oil passage 46 diverges at a diverging point P1 on the connection oil passage including the oil passage 23. Because the second supply oil passage 46 is connected to the oil passage 23, the second supply oil passage 46 becomes a supply oil passage through which hydraulic oil being supplied to the hydraulic actuating device passes. Further, the second supply oil passage 46 is connected to a connection point P2 located in the middle of the first supply oil passage 45.

On the first supply oil passage 45, a side connected to the cylinders 15 and 16 is defined as an upstream side, and a side connected to the discharge oil passage 24 is defined as a downstream side. To the first supply oil passage 45, a check valve 47, a relief pressure valve 48, a filter 49 and an unloading valve 50 are connected in this order from the upstream side toward the downstream side. Predefined operating pressure is set at the relief pressure valve 48. The unloading valve 50 is an electromagnetic valve and is switched between an open state and a closed state. An ON/OFF state of a solenoid of the unloading valve 50 is controlled by the vehicle control device 25.

FIG. 2 illustrates the pressure compensation circuit 37 when the unloading valve 50 is put into a closed state. In this state, the discharge oil passage 24 is not connected to the first supply oil passage 45. FIG. 3 illustrates the pressure compensation circuit 37 when the unloading valve 50 is put into an open state. In this state, the discharge oil passage 24 is connected to the first supply oil passage 45. In this way, the unloading valve 50 is a valve for connecting the first supply oil passage 45 which is a supply oil passage to the discharge oil passage 24.

A diverging oil passage 51 is provided on the first supply oil passage 45. The diverging oil passage 51 diverges from the first supply oil passage 45 and is connected to the first supply oil passage 45. The diverging oil passage 51 is connected to a connection point P3 between the relief pressure valve 48 and the check valve 47 and a connection point P4 between the relief pressure valve 48 and the filter 49. The diverging oil passage 51 can divert the hydraulic oil away from the relief pressure valve 48. An on-off valve 52 is connected to the diverging oil passage 51. The on-off valve 52 operates by a spring force. The on-off valve 52 opens or closes the diverging oil passage 51 by a state of the on-off valve 52 being switched between an open state and a closed state.

Between the on-off valve 52 and a connection point P5 of the second supply oil passage 46, an oil passage 53 is connected. A check valve 54 is connected to the oil passage 53. The check valve 54 allows hydraulic oil to flow from the second supply oil passage 46 toward the on-off valve 52. Further, an oil passage 55 diverging from the oil passage 53 to divert hydraulic oil away from the check valve 54 is connected to the oil passage 53. An orifice 56 is connected to the oil passage 55. As illustrated in FIG. 2, when the unloading valve 50 is put into a closed state, the on-off valve 52 is put into a closed state by receiving pressure against the spring force through the first supply oil passage 45, the second supply oil passage 46 and the oil passage 53 (check valve 54). In other words, when the unloading valve 50 is put into a closed state, pressure of the second supply oil passage 46 is applied to the on-off valve 52 by the check valve 54. On the other hand, as illustrated in FIG. 3 and FIG. 4, when the unloading valve 50 is put into an open state, the above-described pressure applied through the first supply oil passage 45, the second supply oil passage 46 and the oil passage 53 (check valve 54) is lowered, and the on-off valve 52 is put into an open state. As illustrated in FIG. 4, when the on-off valve 52 is put into an open state, the above-described pressure applied to the on-off valve 52 is released to the first supply oil passage 45 through the second supply oil passage 46 via the orifice 56 of the oil passage 55. Further, between the diverging point P1 and the connection point P5 on the second supply oil passage 46, a reducing valve 57 and an orifice 58 are connected.

Operation of the above-described hydraulic mechanism 21 will be described below with reference to FIG. 2 to FIG. 6.

As illustrated in FIG. 2, in the pressure compensation circuit 37 when a load is applied, because the unloading valve 50 is put into a closed state, pressure of the oil passage 23 is not released to the discharge oil passage 24. Therefore, hydraulic oil discharged from the hydraulic pump 20 flows into the tilt cylinder 15 and the lift cylinder 16 through the control valves 39 and 41. That is, FIG. 2 illustrates a state of the pressure compensation circuit 37 during normal cargo handling operation. In this case, the on-off valve 52 is put into a closed state by receiving pressure through the first supply oil passage 45, the second supply oil passage 46 and the oil passage 53 (check valve 54).

The forklift 10 sometimes performs cargo handling operation in a state where a load is applied while pressure inside the hydraulic mechanism 21 is lowered, for example, when the accelerator operating member 31 is not operated and speed of the engine 19 is restricted to be speed for an idle state. In such a case, when the hydraulic actuating device is activated, the load of the hydraulic pump 20 rapidly increases, which may result in deficiency of torque of the engine 19 and may cause an engine stall. Therefore, the vehicle control device 25 controls the engine 19 to avoid an engine stall in a state where rapid fluctuation of the load occurs.

The cargo handling operation includes operation of the tilt cylinder 15 and operation of the lift cylinder 16. Such cargo handling operation becomes a load operation which applies a load to the engine 19. Further, the vehicle control device 25, when detecting that the operator exists at a right operation position based on the detection result of the operator detecting sensor 33, allows cargo handling operation. This state refers to a state where operation of the tilt cylinder 15 and operation of the lift cylinder 16 are allowed.

Figure 3:
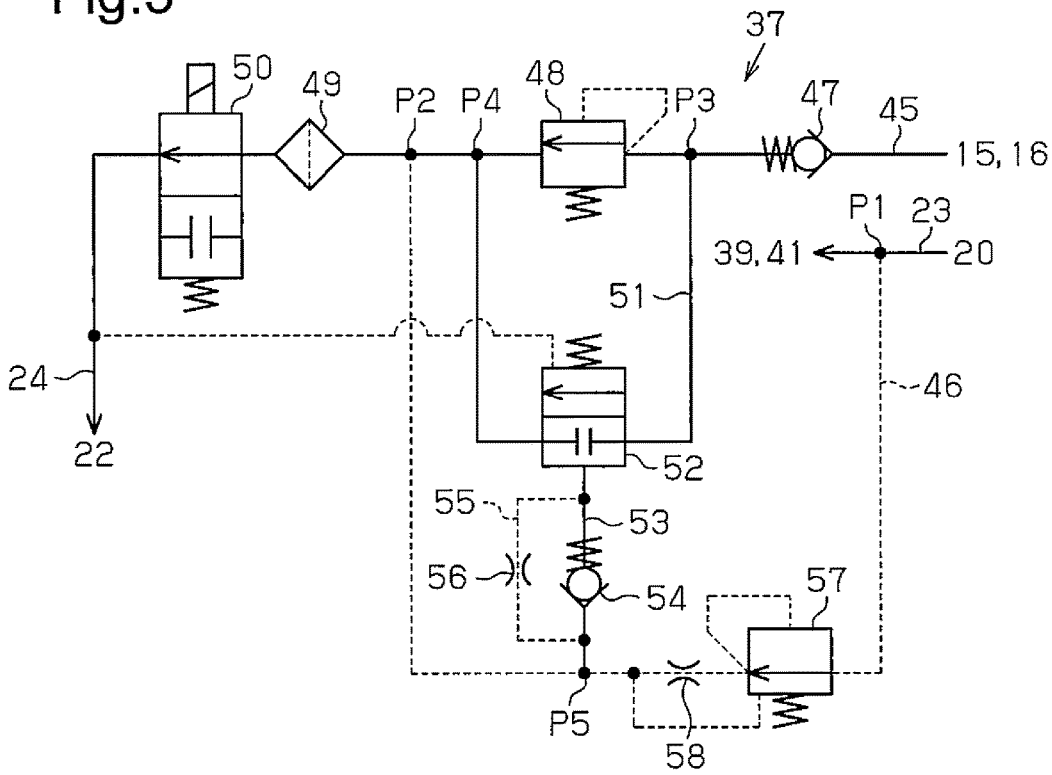
FIG. 3 is a hydraulic circuit diagram explaining the pressure compensation circuit.
Figure 4:
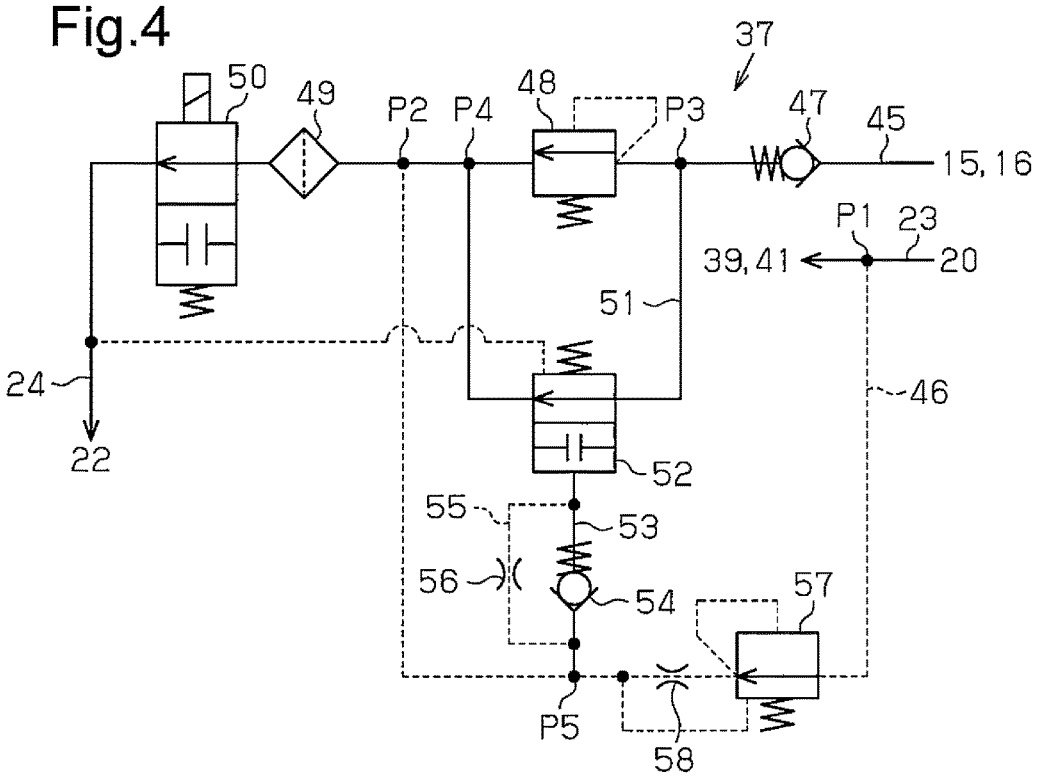
FIG. 4 is a hydraulic circuit diagram explaining the pressure compensation circuit.

Upon instructed to perform a load operation that applies a load to the engine 19, as illustrated in FIG. 3, the vehicle control device 25 switches a state of the unloading valve 50 to an open state. By this means, pressure inside the pressure compensation circuit 37 is released to the discharge oil passage 24. At this time, the hydraulic oil is discharged from the hydraulic pump 20 and flows through the oil passage 23. Meanwhile, the pressure of the oil passage 23 is lowered as the pressure of the pressure compensation circuit 37 is lowered. Further, supply of the hydraulic oil to the tilt cylinder 15 or the lift cylinder 16 through the control valves 39 and 41 increases the pressure of the first supply oil passage 45. Further, regardless of cargo handling operation, the pressure is compensated so that the pressure of the oil passage 23 is slightly higher than the pressure of the first supply oil passage 45.

In the pressure compensation circuit 37, when the pressure of the first supply oil passage 45 reaches operating pressure of the relief pressure valve 48, the relief pressure valve 48 is opened. By this means, the pressure of the first supply oil passage 45 is released to the discharge oil passage 24 through the unloading valve 50, so that the pressure of the first supply oil passage 45 does not increase higher than the operating pressure of the relief pressure valve 48. Further, the pressure of the oil passage 23 is also maintained at pressure slightly higher than the pressure of the first supply oil passage 45. At this time, pressure against the spring force is applied to the on-off valve 52. Therefore, the on-off valve 52 maintains a closed state.

On the other hand, when the vehicle control device 25 switches the state of the unloading valve 50 to an open state, the vehicle control device 25 maintains an open state of the unloading valve 50 for a predetermined time period (for example, several hundred ms). When the predetermined time period has elapsed since the unloading valve 50 was controlled to be put into an open state, the vehicle control device 25 switches the state of the unloading valve 50 to a closed state. As a result, as illustrated in FIG. 2, the pressure compensation circuit 37 is put into a state where the pressure of the first supply oil passage 45 is not released to the discharge oil passage 24. Therefore, the pressure compensation circuit 37 cannot release the pressure outside the circuit. Accordingly, the pressure inside the circuit increases beyond the operating pressure of the relief pressure valve 48. Further, the pressure of the first supply oil passage 45 and the pressure of the second supply oil passage 46 also increase. As a result, pressure required for actuating the tilt cylinder 15 and the lift cylinder 16 is supplied to the control valves 39 and 41 through the oil passage 23, which allows the tilt cylinder 15 and the lift cylinder 16 to be actuated according to the operation of the tilting operating member 27 and the lifting operating member 29.

Figure 5:
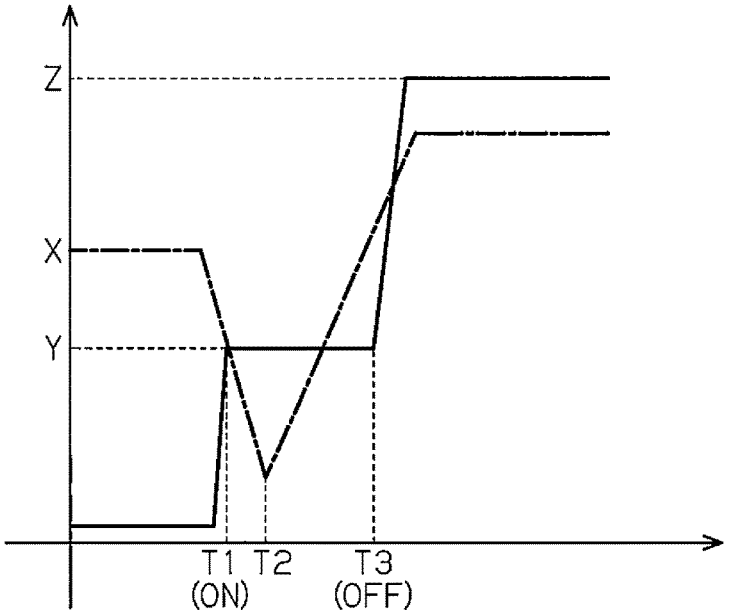
FIG. 5 is a timing chart illustrating change of pressure and engine speed when cargo handling operation is started.

FIG. 5 illustrates change of pressure and engine speed caused by the above-described control. Solid line in FIG. 5 indicates pressure, and dashed-dotted line in FIG. 5 indicates engine speed.

Upon instructed to perform cargo handling operation, the hydraulic pump 20 is driven and pressure of the hydraulic mechanism 21 increases, while the engine speed is lowered from speed X (speed for an idle state). Therefore, as illustrated in FIG. 3, when the unloading valve 50 is put into an open state ("ON" in FIG. 5), as described above, the pressure increases to pressure Y which is equal to the operating pressure of the relief pressure valve 48 (time T1 in FIG. 5). Then, the pressure is maintained at pressure Y. Therefore, an increase of the load of the hydraulic pump 20 is stopped once, so that an engine stall is avoided. Further, at time T2, the engine 19 can recover to increase the engine speed. Then, at time T3, as illustrated in FIG. 2, when the state of the unloading valve 50 is switched to a closed state ("OFF" in FIG. 5), the pressure increases beyond the operating pressure of the relief pressure valve 48. The pressure then reaches pressure Z required for actuating the tilt cylinder 15 and the lift cylinder 16.

As illustrated in FIG. 5, the vehicle control device 25 switches the state of the unloading valve 50 to an open state when the predetermined time period, which is the time period until time T3 has elapsed. Pressure Y, which is the operating pressure of the relief pressure valve 48, is preferably the maximum pressure at which an engine stall can be avoided, and can be calculated through a simulation, or the like. When pressure Y is set too high, as is clear from the change of the engine speed illustrated in FIG. 5, an engine stall is more likely to occur. On the other hand, when the predetermined time period is set too long or pressure Y is set too low, as is clear from FIG. 5, a time period required for the pressure to reach pressure Z may be longer. That is, if the time period required for the pressure to reach pressure Z becomes longer, there is a possibility that even if it is instructed to perform a cargo handling operation, the tilt cylinder 15 and the lift cylinder 16 may not respond for a longer period. As illustrated in FIG. 5, in order to prevent occurrence of an engine stall, the vehicle control device 25 opens or closes the unloading valve 50 of the pressure compensation circuit 37 to increase the pressure within the circuit in two stages.

Next, a control process for restricting the cargo handling operation will be described with reference to FIG. 2 to FIG. 4.

The vehicle control device 25, when detecting that the operator is not located at the right operation position when a load is applied as illustrated in FIG. 2, switches the state of the unloading valve 50 to an open state as illustrated in FIG. 3. By this means, because the relief pressure valve 48 is actuated, the pressure of the first supply oil passage 45 is released to the discharge oil passage 24 through the unloading valve 50. Therefore, the pressure of the first supply oil passage 45 is lowered.

At a time point at which the state of the unloading valve 50 is switched to an open state, the pressure of the oil passage 53 is also released to the discharge oil passage 24. Here, because the pressure of the oil passage 53 attached to the on-off valve 52 is released, the state of the on-off valve 52 is switched from the closed state to the open state by the spring force. A time period required to switch the state is determined by a radius of the orifice 56. As illustrated in FIG. 4, when the state of the on-off valve 52 is switched to an open state, the pressure of the first supply oil passage 45 is released to the discharge oil passage 24 through the on-off valve 52. Meanwhile, the pressure of the oil passage 23 is slightly higher than that of the first supply oil passage 45. Therefore, when the pressure of the first supply oil passage 45 is released to the discharge oil passage 24, the pressure of the oil passage 23 is lowered. As a result, pressure applied to the tilt cylinder 15 and the lift cylinder 16 is lowered. Accordingly, when the operator is not located at the right operation position, even if the operator gives an instruction for a cargo handling operation, operation of the tilt cylinder 15 and the lift cylinder 16 is restricted, and the tilt cylinder 15 and the lift cylinder 16 are not actuated. Here, a timer circuit unit for opening the first supply oil passage 45 when a certain time period has elapsed is constructed of the on-off valve 52, the check valve 54 and the orifice 56.

Figure 6:
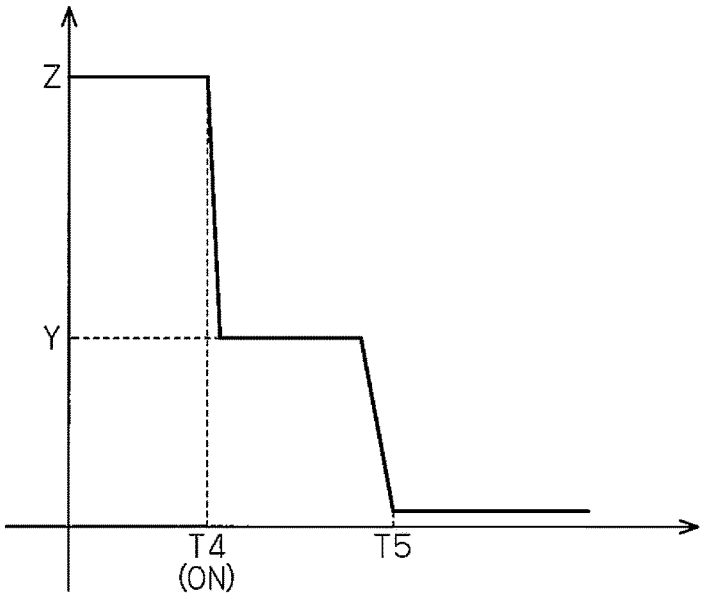
FIG. 6 is a timing chart illustrating change of pressure when cargo handling operation is restricted.

FIG. 6 illustrates change of pressure caused by control for restricting the cargo handling operation. As illustrated in FIG. 6, the vehicle control device 25, when detecting that the operator is not located at the right operation position at time T4, switches the state of the unloading valve 50 to an open state. By this means, the pressure applied to the cylinders 15 and 16 is gradually lowered from pressure Z by being released to the discharge oil passage 24 through the pressure compensation circuit 37. When the pressure reaches the pressure Y and the state of the on-off valve 52 is switched to an open state, the pressure applied to the cylinders 15 and 16 is further lowered and becomes zero at time T5. By this means, even if an instruction for a cargo handling operation is given for some reasons, the cargo handling operation is restricted, and thus is not performed.

Therefore, according to the present embodiment, the following effects can be obtained.

(1) Upon instructed to perform a cargo handling operation that applies load to the engine 19, because the state of the unloading valve 50 is switched to an open state, it is possible to suppress rapid increase of pressure, so that it is possible to prevent occurrence of an engine stall. Further, because the state of the unloading valve 50 is switched to an open state, the pressure within the hydraulic circuit is lowered, so that it is possible to restrict operation of the cylinders 15 and 16. Therefore, it is possible to perform unloading when necessary while preventing occurrence of an engine stall.

(2) The vehicle control device 25, when detecting that the operator is not located at the right operation position, switches the state of the unloading valve 50 to an open state to lower the pressure within the hydraulic circuit, so that it is possible to prevent erroneous operation from occurring for some reasons.

(3) By using the on-off valve 52 which mechanically opens or closes the oil passage, it is possible to simplify the structure of the hydraulic circuit, so that it is possible to prevent an increase in cost.

(4) The vehicle control device 25 can increase the pressure applied to the cylinders 15 and 16 in a stepwise manner, so that it is possible to prevent occurrence of an engine stall by switching the state of the unloading valve 50 to an open state, and then, actuate the cylinders 15 and 16 by switching the state of the unloading valve 50 to a closed state.

The above-described embodiment may be modified as follows.

While in the present embodiment, the state of the unloading valve 50 is switched to an open state through an instruction of cargo handling operation which applies load to the engine 19, there is also a case where load is applied to the engine 19 in a case other than a case where an instruction of cargo handling operation is given, in which case, the engine speed may be lowered. Therefore, when it is detected that the engine speed is lowered, it may be judged that a load is applied to the engine 19. In this case, the state of the unloading valve 50 may be switched to an open state based on the detection that the engine speed is lowered.

Figure 7:
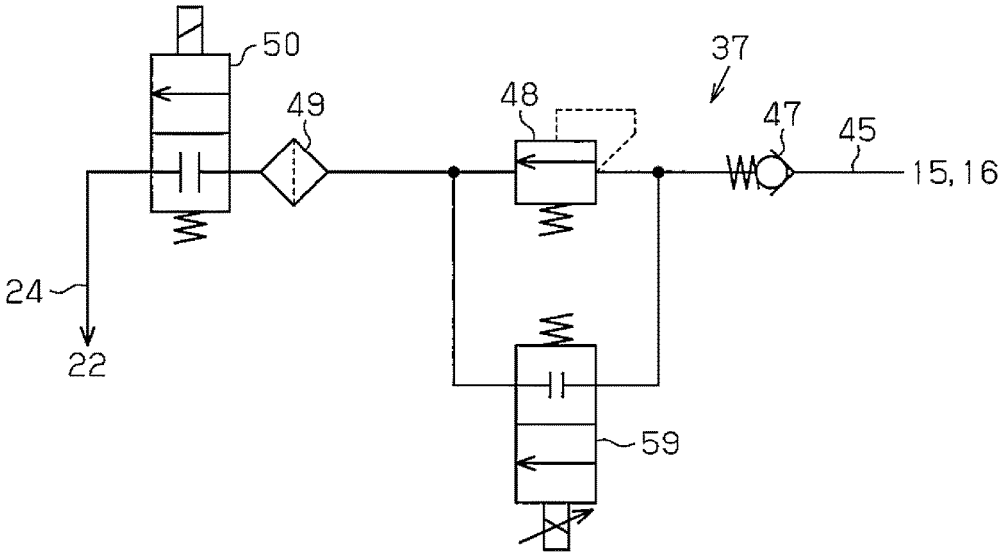
FIG. 7 is a hydraulic circuit diagram explaining a pressure compensation circuit in another example.

As illustrated in FIG. 7, the timer circuit unit may be constructed of an electromagnetic valve 59. When cargo handling operation is restricted, the vehicle control device 25 may switch the state of the electromagnetic valve 59 to an open state after a predetermined time period has elapsed since the state of the unloading valve 50 was switched to an open state, and release the pressure of the first supply oil passage 45 to the discharge oil passage 24.

The forklift 10 may further have a hydraulic cylinder for making an attachment operate as the hydraulic actuating device.

The forklift 10 may further include a hydraulic cylinder for making a power steering mechanism operate as the hydraulic actuating device.

It is also possible to use electromagnetic valves as the control valves 39 and 41 and control opening and closing of the electromagnetic valves by the vehicle control device 25.

The industrial vehicle may be a vehicle having a hydraulic actuating device, such as a shovel loader, other than the forklift 10.

The invention claimed is:

1. An industrial vehicle comprising:

an engine;

a hydraulic pump driven by the engine;

a hydraulic actuating device actuated by hydraulic oil;

a connection oil passage connecting the hydraulic pump and the hydraulic actuating device;

a supply oil passage through which hydraulic oil to be supplied to the hydraulic actuating device passes;

a discharge oil passage through which hydraulic oil to be discharged to an oil tank passes;

an unloading valve connecting the supply oil passage and the discharge oil passage;

a relief pressure valve connected to the supply oil passage and actuated by pressure of the hydraulic oil passing through the supply oil passage;

a timer circuit unit connected to the supply oil passage and opening the supply oil passage when a certain time period has elapsed; and a control unit controlling a state of the unloading valve between an open state and a closed state, wherein the control unit switches the state of the unloading valve to an open state when a load is applied to the engine in a state where operation of the hydraulic actuating device is allowed and switches the state of the unloading valve to an open state while operation of the hydraulic actuating device is restricted, wherein the supply oil passage comprises a first supply oil passage connected to the hydraulic actuating device and a second supply oil passage diverging from the connection oil passage, the relief pressure valve is connected to the first supply oil passage, and the timer circuit unit comprises:

an on-off valve connected to a diverging oil passage and opening or closing the diverging oil passage, the diverging oil passage diverging from the first supply oil passage;

a check valve connected to the second supply oil passage and applying pressure of the second supply oil passage to the on-off valve when the uploading valve is put into a closed state; and an orifice connected to the second supply oil passage and releasing pressure applied to the on-off valve to the first supply oil passage through the second supply oil passage when the unloading valve is put into an open state.

2. The industrial vehicle according to claim 1, wherein when the state of the unloading valve is switched to the open state when load is applied to the engine, the control unit switches the state of the unloading valve to the closed state after a predetermined time period has elapsed since the state of the unloading valve was switched to the open state.

3. The industrial vehicle according to claim 1, wherein upon instructed to perform a load operation, the control unit increases pressure of hydraulic oil to be supplied to the hydraulic actuating device to first pressure which is equal to operating pressure of the relief pressure valve by switching the state of the unloading valve to the open state, and increases the pressure of the hydraulic oil to be supplied to the hydraulic actuating device to second pressure required to actuate the hydraulic actuating device by switching the state of the unloading valve to tithe closed state after a predetermined time has elapsed.

* * * * *